US007112104B2

(12) United States Patent
Sagawa et al.

(10) Patent No.: US 7,112,104 B2
(45) Date of Patent: Sep. 26, 2006

(54) ELECTRICAL CONNECTOR

(75) Inventors: Tetsuya Sagawa, Kodaira (JP); Yasumasa Aita, Machida (JP); Tomoaki Kajii, Sagamihara (JP); Ryo Sawada, Isehara (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 10/964,256

(22) Filed: Oct. 13, 2004

(65) Prior Publication Data

US 2005/0112943 A1 May 26, 2005

(30) Foreign Application Priority Data

Oct. 16, 2003 (JP) ..... 2003-356655

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 5,059,142 A 10/1991 Ohta et al.
5,931,700 A 8/1999 Saito et al.
6,149,462 A * 11/2000 Sugie ..... 439/595
6,290,539 B1 * 9/2001 Wilber et al. ..... 439/595

FOREIGN PATENT DOCUMENTS

| | | |
|---|---|---|
| EP | 1 168 516 A2 | 1/2001 |
| JP | 03-005098 | 10/1987 |
| JP | 2002-025705 | 1/2002 |

* cited by examiner

*Primary Examiner*—Tho D. Ta
*Assistant Examiner*—Vanessa Girardi
(74) *Attorney, Agent, or Firm*—Barley Snyder LLC

(57) ABSTRACT

An electrical connector comprises a retainer that is inserted from the front surface of the connector housing and locked to the housing in a temporary locking position and in a main locking position, wherein the state of the retainer in the main locking position can easily be confirmed by visual inspection or by using an inspection probe. The retainer has main locking arms comprising main locking projections which prevent the retainer from being pushed in when the retainer is in the temporary locking position, and which prevent the retainer from being pulled out when the retainer is in the main locking position. The main locking projections are exposed through the housing when the retainer is in the main locking position. The housing has supporting parts that support the back surface of the main locking arms in the vicinity of the main locking projections when the retainer is in the main locking position.

6 Claims, 15 Drawing Sheets

ELECTRICAL CONNECTOR

FIELD OF THE INVENTION

The present invention relates to an electrical connector comprising a front insertion retainer inserted from the front surface of the housing, and being locked to the housing in a temporary locking position that allows the insertion of contacts into the housing and in a main locking position that ensures that the contacts are prevented from slipping out of the housing.

BACKGROUND

An exemplary conventional electrical connector is shown in FIGS. 19A and 19B (see Japanese Utility Model Application Kokoku No. H3-5098). The electrical connector comprises a retainer that is inserted from the front surface of the housing, i.e., a so-called front insertion type retainer.

The electrical connector 101 shown in FIGS. 19A and 19B comprises an insulating housing 110, contacts 120 that are accommodated in this housing 110, and a retainer 130 that is inserted from the front surface of the housing 110 and that ensures that the contacts 120 are prevented from slipping out of the housing 110.

A plurality of contact accommodating cavities 111 for accommodating the contacts 120 are formed inside the housing 110. A housing lance 112 for accommodating the corresponding contact 120 is disposed inside each contact accommodating cavity 111. A space 113 that allows the flexing of the housing lance 112 is formed beneath each housing lance 112 (below in FIG. 19A).

Furthermore, the retainer 130 is constructed so that this retainer is inserted into the housing 110 from the front surface (left surface in FIG. 19A) of the housing 110, and comprises a plurality of regulating parts 131 that advance into the spaces 113 formed beneath the housing lances 112 and restrict the downward movement of the housing lances 112, thus ensuring that the contacts 120 do not slip out. A pair of locking parts 132 protrude from the side walls of the retainer 130 and are positioned to advance into locking holes 114 formed in both side walls of the housing 110 to prevent the retainer 130 from slipping out with respect to the housing 110. In this electrical connector 101, since the locking parts 132 enter the locking holes 114 formed in both side walls of the housing 110 when the retainer 130 is in the locking position, visual confirmation that the retainer 130 is in the locking position can be accomplished by visually inspecting the locking parts 132 from the outside of the housing 110.

An exemplary electrical connector 201 is shown in FIG. 20 (see Japanese Patent Application Kokai No. 2002-25705) which is constructed such that the locked state of the electrical connector and the mating connector can be confirmed by visual inspection. It should be noted that this is not an electrical connector of the type that is equipped with the front insertion type retainer.

The electrical connector 201 shown in FIG. 20 comprises a housing 210 that accommodates a plurality of female contacts (not shown in the figure), a supporting part (not shown) that protrudes upward from the housing 210, and a pair of arm parts 212 that respectively extend in the forward-rearward direction from the left and right side edges of the supporting part. Furthermore, locking projecting parts 213 are formed so that these parts 213 protrude from the front ends (upper ends in FIG. 20) of the respective arm parts 212, and operating parts 214 are formed on the rear ends of the respective arm parts 212. Furthermore, detection projecting parts 215 are formed so that these parts 215 protrude to the outside on the front ends of the operating parts 214 of the respective arm parts 212.

Meanwhile, the mating connector 301 that mates with the electrical connector 201 comprises a housing 310 to which a plurality of male contacts 311 are fastened, and a hood part 312 that surrounds the housing 310 and that extends forward (downward in FIG. 20). A pair of locking parts 313 to which the locking projecting parts 213 are secured at the time of mating with the electrical connector 201 are formed on the hood part 312. Furthermore, window holes 314 into which the detection projecting parts 215 advance when the locking projecting parts 213 are locked to the locking parts 313 are formed in the left and right side walls of the hood part 312.

In this electrical connector 201, since the detection projecting parts 215 advance into the window holes 314 formed in the hood part 312 of the mating connector 301 at the time of locking with the mating connector 301, the locked state of the electrical connector 201 with the mating connector 301 can be visually confirmed by visually inspecting the detection projecting parts 215 from the outside of the hood part 312.

However, the following problems have been encountered in these conventional electrical connectors.

Specifically, in the case of the electrical connector 101 shown in FIGS. 19A and 19B, the main body of the retainer 130 possesses rigidity against the locking parts 132 that are disposed on both side walls of this main body. Accordingly, when the retainer 130 is inserted from the front surface of the housing 110 and moved to the locking position, there is a danger that the locking parts 132 will be crushed by the side walls of the housing 110, or that the side walls of the housing 110 will be deformed. On the other hand, if the protruding height of the locking parts 132 is reduced in order to prevent the crushing of the locking parts 132 or deformation of the side walls of the housing 110, there is a danger that visual confirmation of the locking parts 132 when the retainer 130 is in the locking position will become difficult.

Furthermore, besides visual confirmation of the state of the retainer 130 in the locking position, there is also a demand for a method for measuring the height of the locking parts 132 from a specified reference by causing the inspection probe to contact the top surfaces of the locking parts 132 and thus detecting the state of the retainer in the locking position Meanwhile, in the case of the electrical connector 201 shown in FIG. 20, each of the pair of arm parts 212 possesses flexibility, and has a structure that allows swinging inward and outward about the left and right side edges of the supporting part. Accordingly, each of the arm parts 212 can flex inward even in a state in which the detection protruding parts 215 have advanced into the window holes 314. In this electrical connector 201, when an attempt is made to measure the height of the detection protruding parts 215 from a specified reference by causing the inspection probe to contact the top surfaces of the detection protruding parts 215, each of the arm parts 212 flexes inward as a result of the pressing of the inspection probe, so that the detection protruding parts 215 are retracted to the inside, thus making measurement impossible. Accordingly, the locked state with the mating connector 301 cannot be accurately detected using an inspection probe.

SUMMARY

The present invention was devised in light of the problems described above; it is an object of the present invention to provide an electrical connector equipped with a retainer that can be inserted from the front surface of the housing, and that can be secured in the housing in a temporary locking position that allows the insertion of contacts into the housing and in a main locking position that ensures that the contacts will not slip out, wherein the state of the retainer in the main locking position can easily be confirmed either by visual inspection or by using an inspection probe.

According to an exemplary embodiment of the invention, an electrical connector is provided, comprising: an insulating housing; contacts that are accommodated in this housing; and a retainer that is inserted from the front surface of the housing, and that is locked to the housing in a temporary locking position that allows the insertion of the contacts into the housing and in a main locking position that ensures that the contacts are prevented from slipping out of the housing, this retainer having main locking arms comprising main locking projections that prevent the retainer from being pushed inward when the retainer is in the temporary locking position, and that prevent the retainer from being pulled out when the retainer is in the main locking position, and these main locking projections being exposed from the side surfaces of the housing when the retainer is in the main locking position, wherein the housing has supporting parts that support the back surface sides of the main locking arms in the vicinity of the main locking projections when the retainer is in the main locking position.

DETAILED DESCRIPTION OF THE EMBODIMENT(S)

Next, embodiments of the present invention will be described with reference to the figures. In FIG. 1A to 1C and 2A to 2C, a plug connector 1 comprises an insulating housing 10, a plurality of contacts 20 that are accommodated in this housing 10 in two rows (upper and lower rows), and a retainer 30 for ensuring that the contacts 20 do not slip out.

Figure 1A:
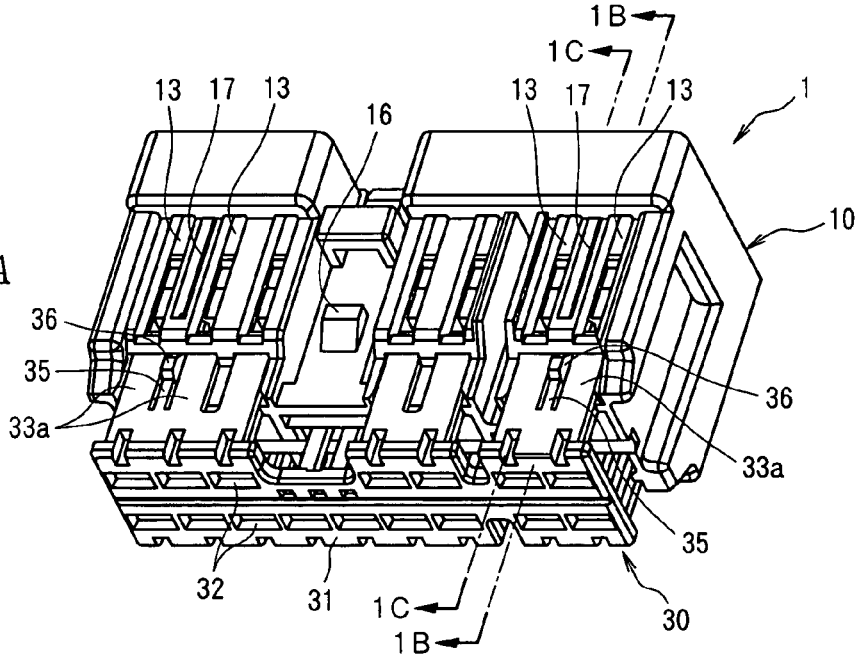
FIG. 1A to 1C show a plug connector according to an exemplary embodiment of the invention in a state in which the retainer is in the temporary locking position, with FIG. 1A being a perspective view, FIG. 1B being a sectional view along line 1B—1B in FIG. 1A, and FIG. 1C being a sectional view along line 1C—1C in FIG. 1A (here, the contacts are not shown in FIG. 1B)
Figure 2C:
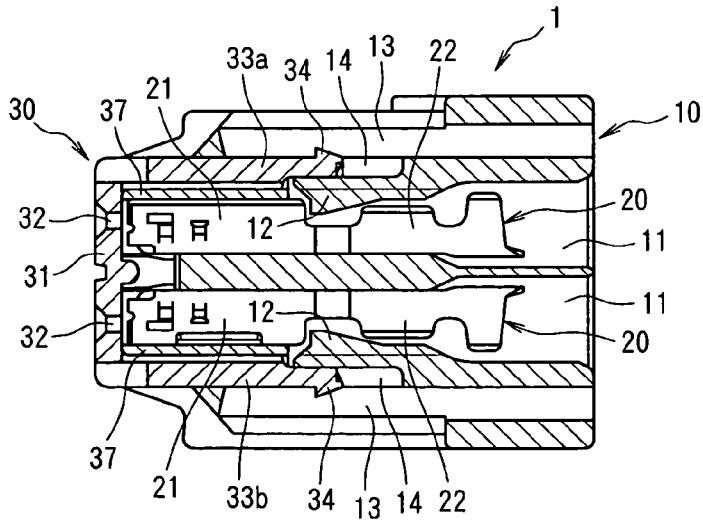
Figure 3:
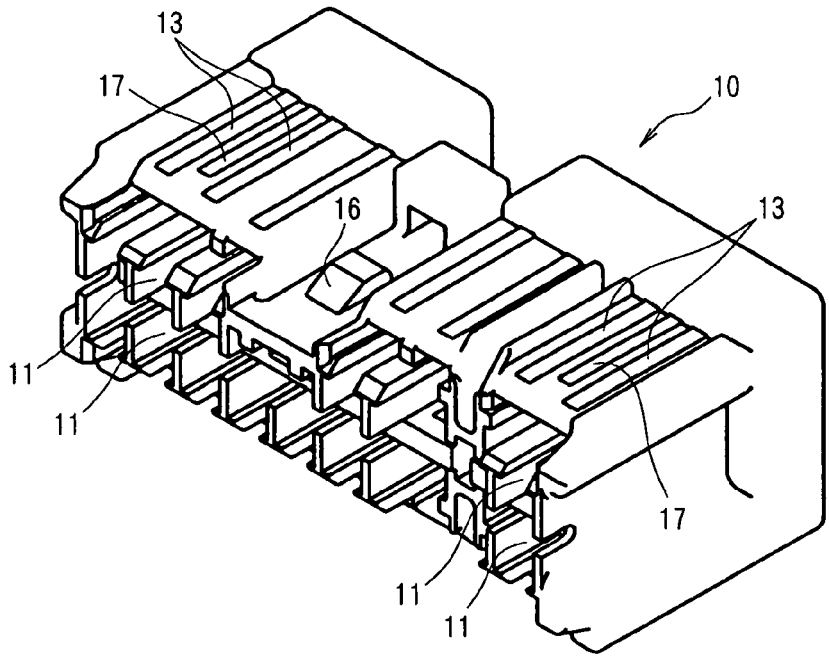
FIG. 3 is a perspective view of the connector of FIGS. 1A–2C, in which the housing is seen from the front at an inclination from above.
Figure 4:
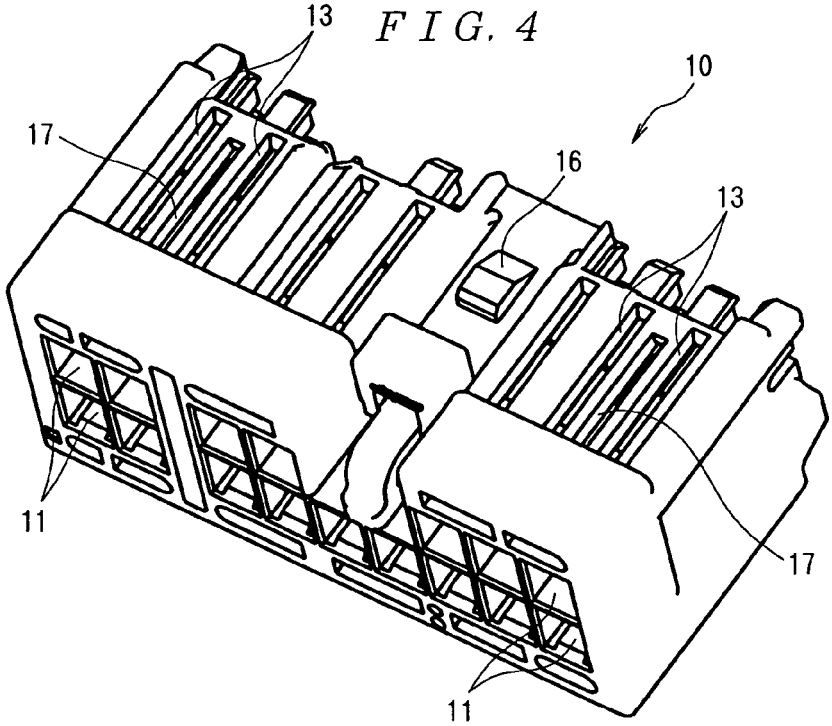
FIG. 4 is a perspective view of the connector of FIGS. 1A–2C, in which the housing is seen from the rear at an inclination from above.
Figure 5:
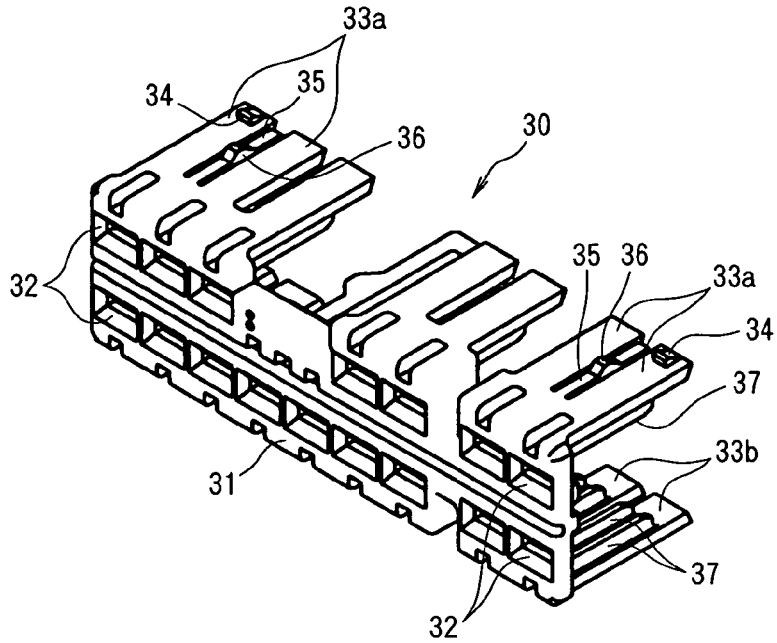
FIG. 5 is a perspective view of the retainer of the connector of FIGS. 1A–2C, in which the retainer is seen from the front at an inclination from above.
Figure 6:
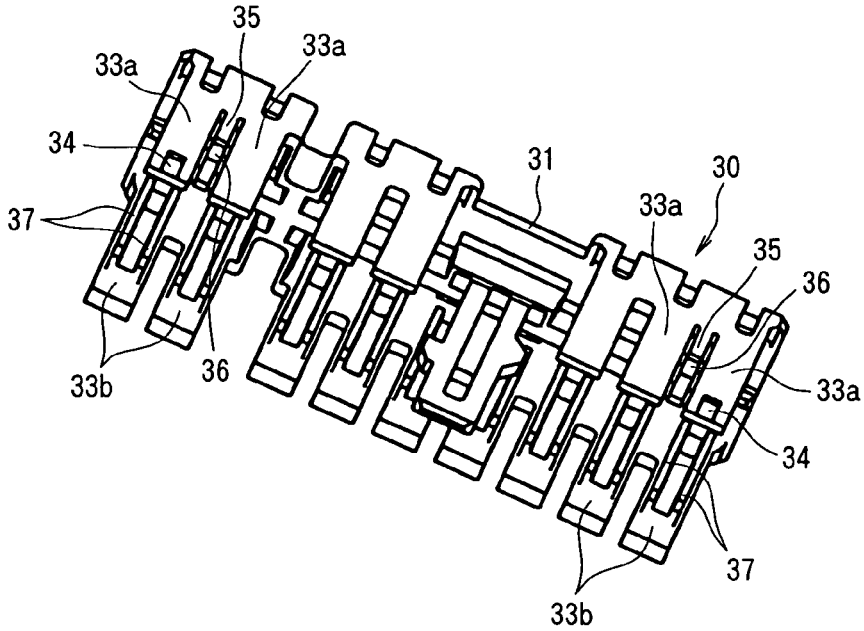
FIG. 6 is a perspective view of the retainer of FIG. 5 shown from the rear at an inclination from above.
Figure 7:
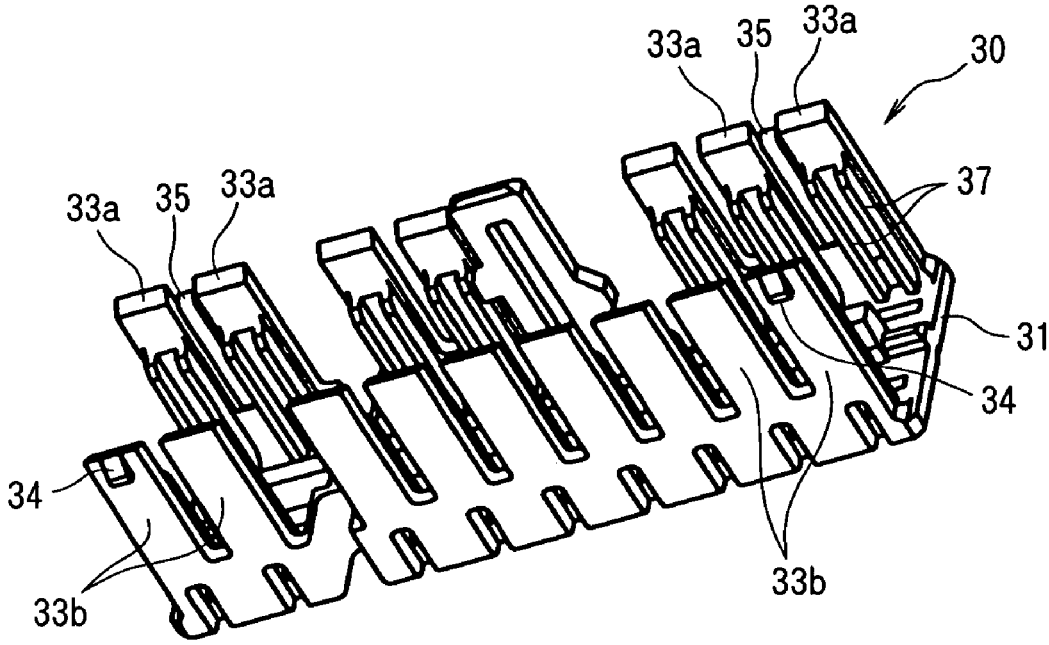
FIG. 7 is a perspective view of the retainer of FIG. 5 shown from the rear at an inclination from below.

The housing 10, as shown in FIGS. 3 and 4, is formed with a substantially rectangular shape by molding an insulating synthetic resin, and has a plurality of contact accommodating cavities 11 (that accommodate contacts 20 inside) in two rows (upper and lower rows extending in the left-right direction in FIG. 1A). As is shown in FIG. 3, each contact accommodating cavity 11 opens on the front side of the housing 10 (left side in FIGS. 1C and 2C, front side in FIG. 3). Furthermore, a housing lance 12 for securing the corresponding contact 20 is disposed in each contact accommodating cavity 11. The housing lances 12 disposed in the contact accommodating cavities 11 of the upper row are formed so that these housing lances extend forward at an inclination from the top wall of the housing 10; on the other hand, the housing lances 12 disposed in the contact accommodating cavities 11 of the lower row are formed so that these housing lances extend forward at an inclination from the bottom wall of the housing 10.

Figure 8A:
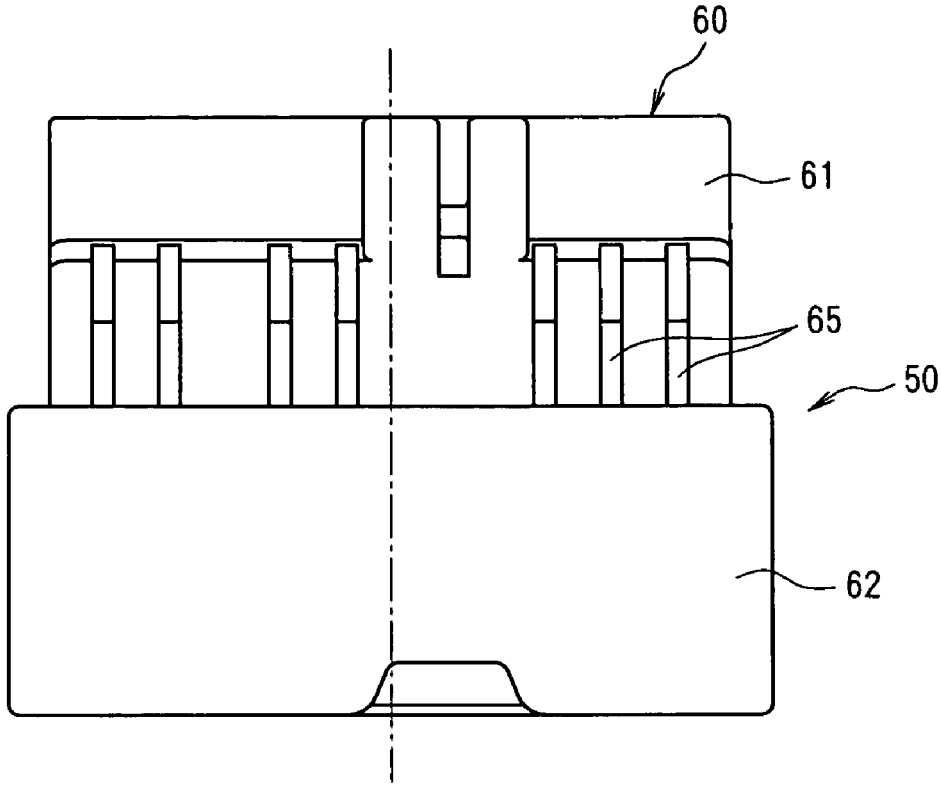
FIGS. 8A and 8B show a cap connector according to an exemplary embodiment of the invention in a state in which the retainer is in the temporary locking position, with FIG. 8A being a plan view, and FIG. 8B being a front view.
Figure 8B:
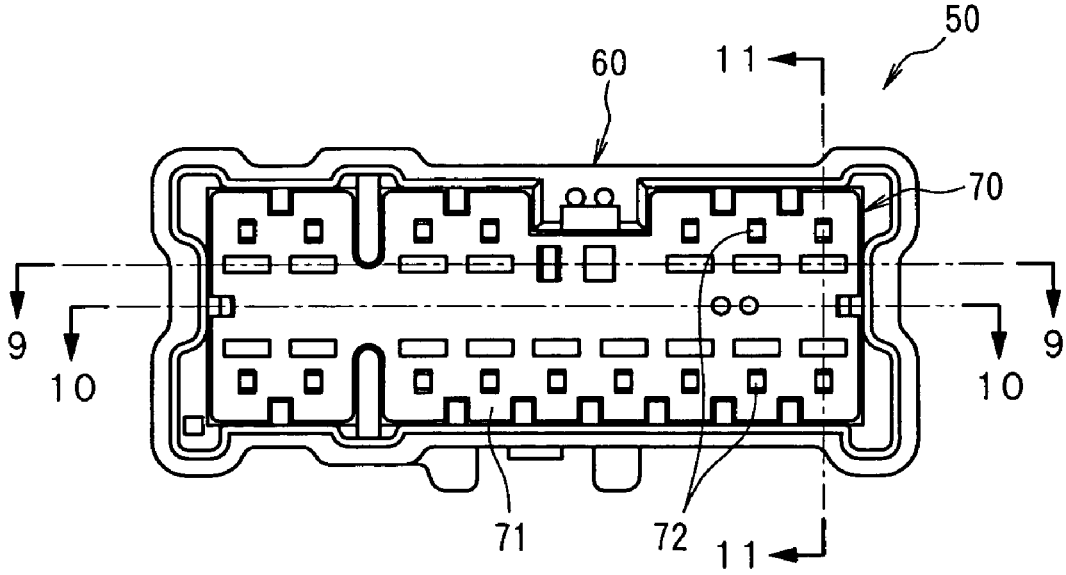

Furthermore, a plurality of first long narrow openings 13 that extend in the forward-rearward direction are respectively formed in the top wall and bottom wall of the housing 10 in positions corresponding to the respective contact accommodating cavities 11 in the left-right direction. The width of the respective first long narrow openings 13 is narrower than the width of the respective contact accommodating cavities 11. Furthermore, spaces 14 that permit flexing of the housing lances 12 and that allow the entry of the upper-side regulating parts 33*a* (described later) of the retainer 30 are formed above the housing lances 12 of the upper row so that these spaces 14 communicate with the first long narrow openings 13. Moreover, spaces 14 that permit flexing of the housing lances 12 and that allow the entry of the lower-side regulating parts 33*b* (described later) of the retainer 30 are also formed beneath the housing lances 12 of the lower row so that these spaces 14 communicate with the first long narrow openings 13. The respective spaces 14 open on the front side of the housing 10. Furthermore, slits 15 (see FIG. 1C) that communicate with the spaces 14 and that open on the front side of the housing 10 are formed on the front side of the housing lances 12 of the respective contact accommodating cavities 11. Moreover, second long narrow openings 17 that extend in the forward-rearward direction are respectively formed in the top wall of the housing 10 between the first long narrow opening 13 at the leftmost end and the adjacent first long narrow opening 13 and between the first long narrow opening 13 at the rightmost end and the adjacent first long narrow opening 13. Spaces 18 that allow the entry of the main locking arms 35 (described later) of the retainer 30 are formed beneath the second long narrow openings 17 so that these spaces 18 communicate with the second long narrow openings 17. The spaces 14 described above and these spaces 18 communicate with each other. A locking projection 16 that locks with a cap connector 50 (see FIG. 8A and 8B) at the time of mating with this cap connector 50 is formed on the top wall of the housing 10.

Each contact 20 may be formed, for example, by stamping and forming a metal plate, and comprises a substantially box-shaped receptacle part 21 that is secured by the corresponding housing lance 12, and an electrical wire connecting part 22 that extends rearward from the receptacle part 21, and that is connected by crimping to one of the electrical wires of a wire harness (not shown in the figures). An elastic contact part 23 that makes elastic contact with a mating male contact (not shown in the figures) is disposed inside the receptacle part 21.

The retainer 30 is inserted from the front surface of the housing 10, and is locked in the housing 10 in a temporary locking position (see FIG. 1A to 1C) by temporary locking projections 34 (described later) on the main locking arms 35. This temporary locking position that allows the insertion of the contacts 20 into the housing 10. The retainer may then be locked in a main locking position (see FIG. 2A to 2C) by main locking projections 36 (described later) to ensure that the contacts 20 do not slip out. The retainer 30 comprises a substantially rectangular, flat plate 31 that extends in the direction of length (left-right direction in FIG. 1A) so as to cover the front surface of the housing 10, and a plurality of upper-side regulating parts 33*a* and lower-side regulating parts 33*b* that respectively extend rearward from the upper and lower ends of the plate 31.

The respective upper-side regulating parts 33*a* enter into the spaces 14 formed above the housing lances 12 at the time of main locking, and restrict the upward movement of the housing lances 12, thus ensuring that the contacts 20 of the upper row do not slip out. Furthermore, the respective lower-side regulating parts 33*b* enter into the spaces 14 formed beneath the housing lances 12 at the time of main locking, and restrict the downward movement of the housing lances 12, thus ensuring that the contacts 20 of the lower row do not slip out. A plurality of mating contact passage holes 32 in two rows (upper and lower rows) are formed in the plate 31 in positions corresponding to the respective contact accommodating cavities 11. Furthermore, as is shown clearly in FIG. 1C and FIG. 5 through 7, temporary locking projections 34 that prevent the retainer 30 from being pulled out in the forward direction when the retainer 30 is in the temporary locking position are respectively formed on the rear ends of the upper-side regulating parts 33*a* and lower-side regulating parts 33*b* that are positioned at both ends in the direction of length. The upper-side regulating parts 33*a* and lower-side regulating parts 33*b* that are positioned at both ends in the direction of length constitute temporary locking arms. Furthermore, a pair of regulating parts 37 that enter the slits 15 of the upper row and restrict the upward movement of the receptacle parts 21 of the contacts 20 of the upper row are formed so that these regulating parts 37 protrude from the respective upper-side regulating parts 33*a*. Moreover, a pair of regulating parts 37 that enter the slits 15 of the lower row and restrict the downward movement of the receptacle parts 21 of the contacts 20 of the lower row are similarly formed so that these regulating parts 37 protrude from the respective lower-side regulating parts 33*b*.

Figure 1B:
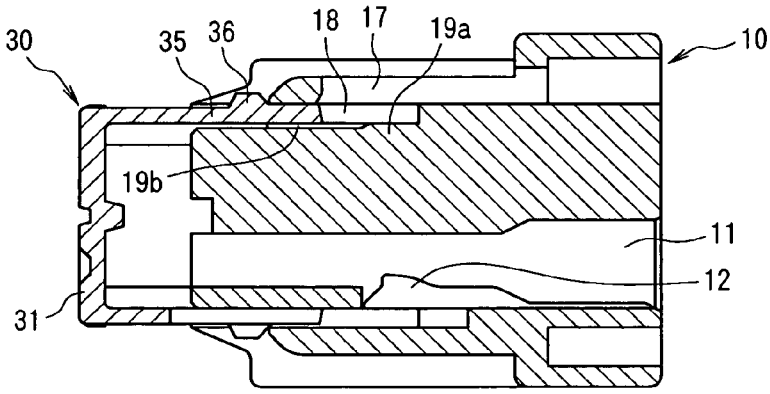

Main locking arms 35 are respectively formed between the upper-side regulating part 33*a* at the leftmost end and the adjacent upper-side regulating part 33*a* and between the upper-side regulating part 33*a* at the rightmost end and the adjacent upper-side regulating part 33*a*. The respective main locking arms 35 are formed so that these arms 35 enter into the spaces 18 formed beneath the second long narrow openings 17 at the time of main locking. As is shown in FIGS. 1B and 2B, main locking projections 36 which are used to prevent the retainer 30 from being pushed in toward the rear when the retainer 30 is in the temporary locking position, and which are used to prevent the retainer 30 from being pulled out in the forward direction when the retainer 30 is in the main locking position, are formed to protrude from the respective main locking arms 35 in positions located slightly toward the rear (in the forward-rearward direction) of the respective main locking arms 35. As is shown in FIG. 2B, the main locking projections 36 are formed so that these projections 36 are exposed from the top surface of the housing 10 via the second long narrow openings 17 when the retainer 30 is in the main locking position.

Moreover, as is shown in FIG. 2B, supporting parts 19*a* that support the back surface of the main locking arms 35 in the vicinity of the main locking projections 36 when the retainer 30 is in the main locking position are formed beneath the spaces 18 of the housing 10. Furthermore, flex permitting spaces 19*b* that allow flexing of the main locking arms 35 of the retainer 30 when the retainer 30 moves from the temporary locking position to the main locking position are formed in positions located further forward than the supporting parts 19*a* of the housing 10.

Next, the method for assembling the plug connector 1 will be described with reference to FIG. 1A to 1C and 2A to 2C.

Figure 1C:
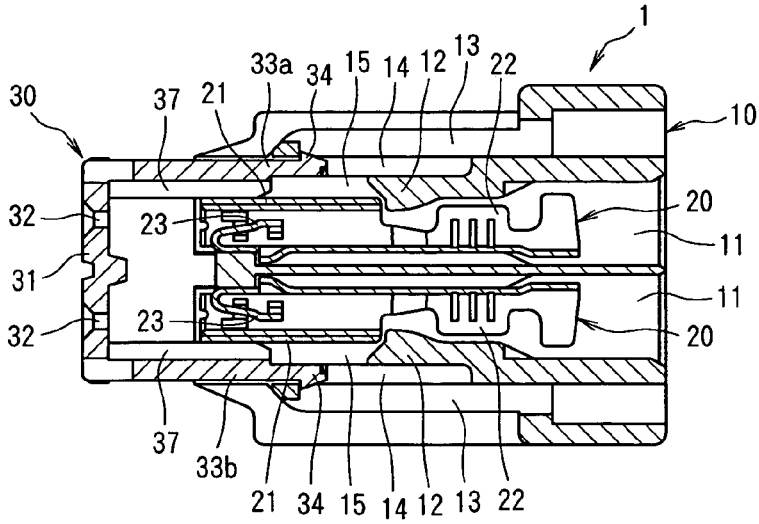

In the assembly of the plug connector 1, the retainer 30 is first inserted from the front surface of the housing 10, and the retainer 30 is positioned in the temporary locking position as shown in FIG. 1A to 1C. In this case, the retainer 30 is prevented from being pulled out in the forward direction as a result of the temporary locking projections 34 formed on the rear ends of the upper-side regulating parts 33*a* and lower-side regulating parts 33*b* contacting the front edges of the first long narrow openings 13, and the retainer 30 is prevented from being pushed in toward the rear as a result of the main locking projections 36 contacting the front edge of the top wall of the housing 10.

Next, the respective contacts 20 to which electrical wires have been connected are inserted into the respective contact accommodating cavities 11 from the rear side of the housing 10. As a result, the housing lances 12 are positioned on the rear sides of the receptacle parts 21 of the contacts 20, so that the contacts 20 are tentatively secured, thus preventing the contacts 20 from slipping out.

Figure 2A:
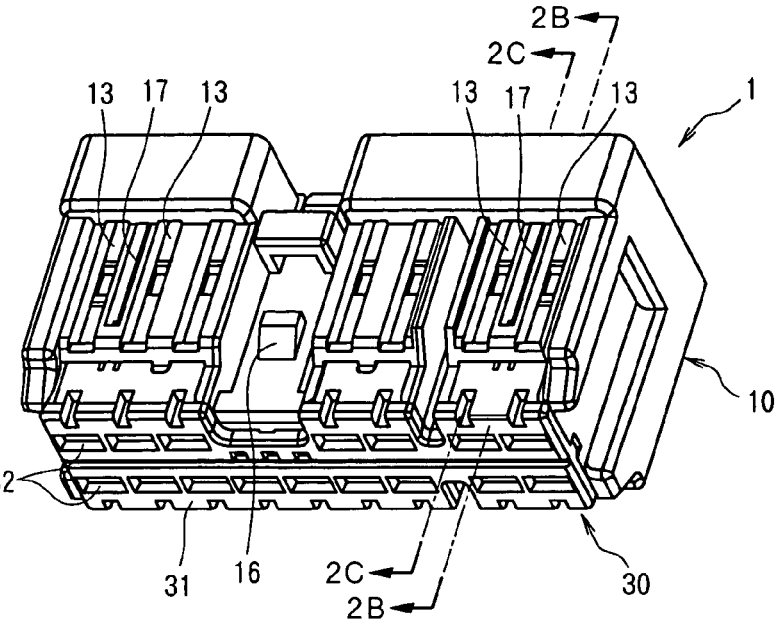
FIG. 2A to 2C show the connector of FIGS. 1A–1C in a state in which the retainer is in the main locking position, with FIG. 2A being a perspective view, FIG. 2B being a sectional view along line 2B—2B in FIG. 2A, and FIG. 2C being a sectional view along line 2C—2C in FIG. 2A (here, the contacts are not shown in FIG. 2B)
Figure 2B:
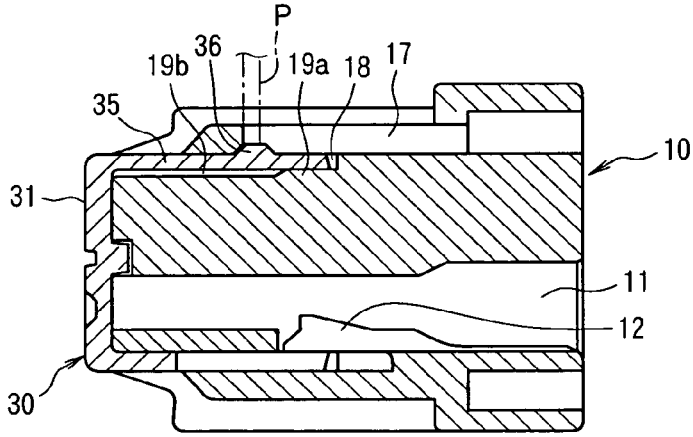

Subsequently, the retainer 30 that is in the temporary locking position is pushed rearward so that the retainer 30 is positioned in the main locking position as shown in FIG. 2A to 2C. In this case, the main locking arms 35 of the retainer 30 enter into the spaces 18 formed beneath the second long narrow openings 17, and the main locking projections 36 contact the front edges of the second long narrow openings 17, so that the retainer 30 is prevented from being pulled out in the forward direction. Furthermore, since the flex permitting spaces 19*b* that allow flexing of the main locking arms 35 of the retainer 30 are formed in positions located further forward than the supporting parts 19*a* of the housing 10, the work of moving the retainer 30 from the temporary locking position to the main locking position can easily be accomplished. In the case of this main locking, furthermore, the upper-side regulating parts 33*a* of the retainer 30 enter into the spaces 14 formed above the housing lances 12, so that the upward movement of the housing lances 12 is restricted, thus ensuring that the contacts 20 of the upper row are prevented from slipping out. Moreover, the lower-side regulating parts 33*b* of the retainer 30 enter into the spaces 14 formed beneath the housing lances 12, so that the downward movement of the housing lances 12 is restricted, thus ensuring that the contacts 20 of the lower row are prevented from slipping out. As a result, the assembly of the plug connector 1 is completed.

When the retainer 30 is in the main locking position, the main locking projections 36 are exposed from the top surface of the housing 10 via the second long narrow openings 17 as shown in FIG. 2B, so that the main locking projections 36 can be visually confirmed from the side of the top surface of the housing 10. As a result, the state of the retainer 30 in the main locking position can easily be confirmed by visual inspection.

Moreover, since the main locking projections 36 are exposed from the top surface of the housing 10 via the second long narrow openings 17 when the retainer 30 is in the main locking position, the state of the retainer 30 in the main locking position can also be detected by causing an inspection probe P (see FIG. 2B) to contact the top surfaces of the main locking projections 36 from the top surface side of the housing 10 as shown in FIG. 2B, and by measuring the height of the main locking projections 36 from a specified reference. In this case, since the supporting parts 19*a* that support the back surfaces of the main locking arms 35 in the vicinity of the main locking projections 36 when the retainer 30 is in the main locking position are formed beneath the spaces 18 of the housing 10, the main locking projections 36 do not retract downward even if the inspection probe P is caused to contact the top surfaces of the main locking projections 36 from the top surface of the housing 10. Consequently, the state of the retainer 30 in the main locking position can be securely detected. Furthermore, the top surfaces of the main locking projections 36 are formed as flat surfaces that allow surface contact with the inspection probe P.

Next, a cap connector 50 constituting the electrical connector of the present invention will be described with reference to FIGS. 8A and 8B, 9, 10, 11, 12A and 12B, 13 through 18. In FIGS. 8A and 8B, 9 through 11, 12A and 12B, and 13 through 15, the cap connector 50 is a connector that mates with the plug connector 1 shown in FIG. 1A to 1C, and comprises an insulating housing 60, a plurality of contacts (not shown in the figures) that are accommodated in this housing 60 in two rows (upper and lower rows), and a retainer 70 for ensuring that the contacts do not slip out. Each of the contacts is a male type contact that is designed to contact and mate with the receptacle part 21 of the corresponding contact 20 disposed in the plug connector 1 shown in FIG. 1A to 1C.

Figure 11:
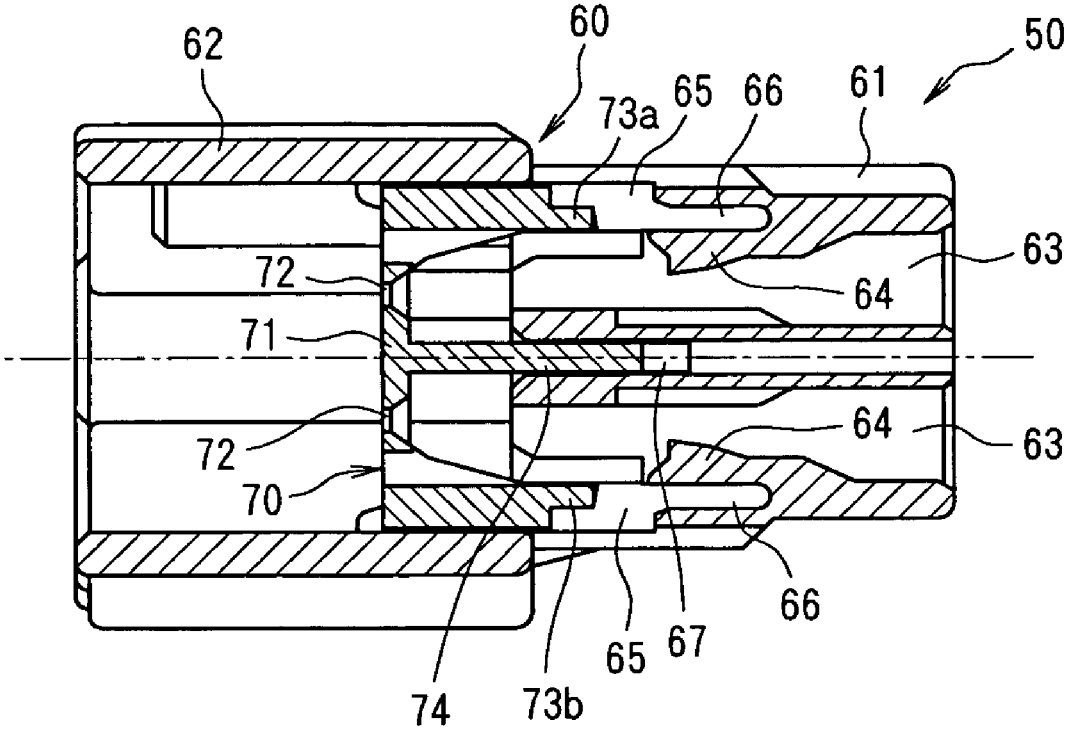
FIG. 11 is a sectional view along line 11—11 in FIG. 8B.
Figure 12A:
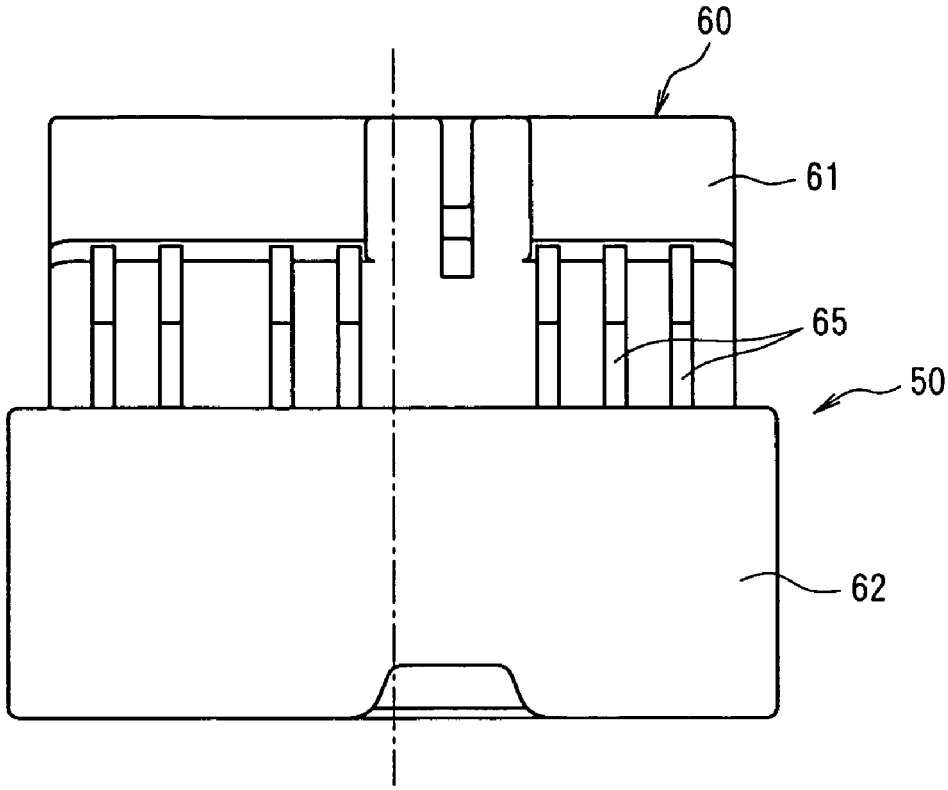
FIGS. 12A and 12B show the cap connector of FIGS. 8A–11 in a state in which the retainer is in the main locking position, with FIG. 12A being a plan view, and FIG. 12B being a front view.
Figure 12B:
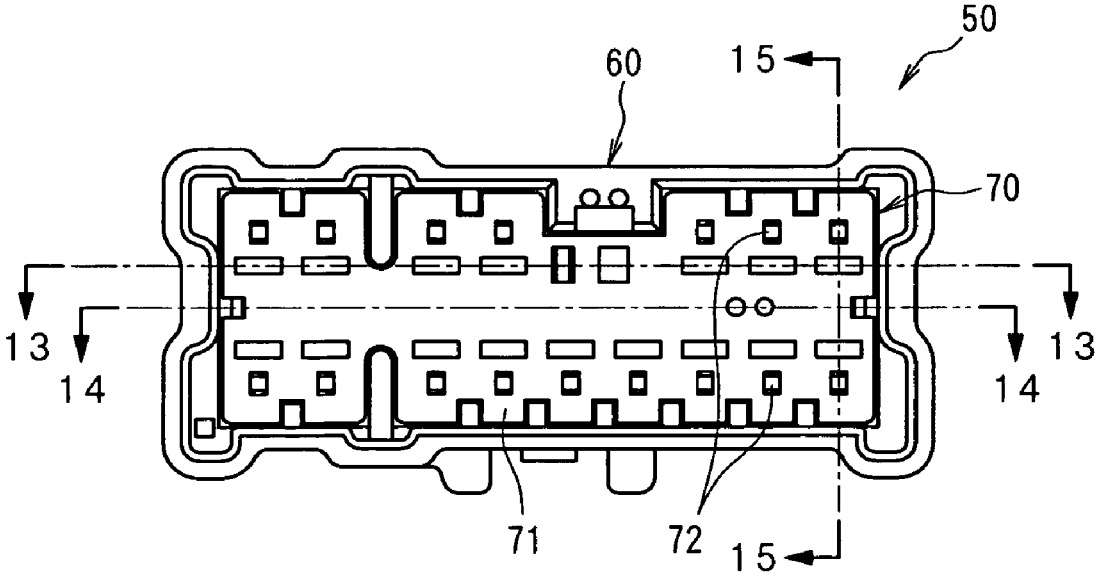

The housing 60 is formed by molding an insulating synthetic resin, and comprises a substantially rectangular contact accommodating part 61 and a hood part 62 that extends forward (downward in FIG. 8A) from the contact accommodating part 61. A plurality of contact accommodating cavities 63 that accommodate the contacts are formed inside the contact accommodating part 61. The contact accommodating cavities 63 are formed in two rows (upper and lower rows) in the left-right direction (in the left-right direction in FIG. 8A) of the contact accommodating part 61. Each contact accommodating cavity 63 opens on the front side of the contact accommodating part 61. Furthermore, as is shown in FIG. 11, a housing lance 64 for securing the corresponding contact is disposed in each of the contact accommodating cavities 63. The housing lances 64 disposed in the contact accommodating cavities 63 of the upper row are formed so that these housing lances extend forward at an inclination from the top wall of the contact accommodating part 61; on the other hand, the housing lances 64 disposed in the contact accommodating cavities 63 of the lower row are formed so that these housing lances extend forward at an inclination from the bottom wall of the contact accommodating part 61.

Figure 9:
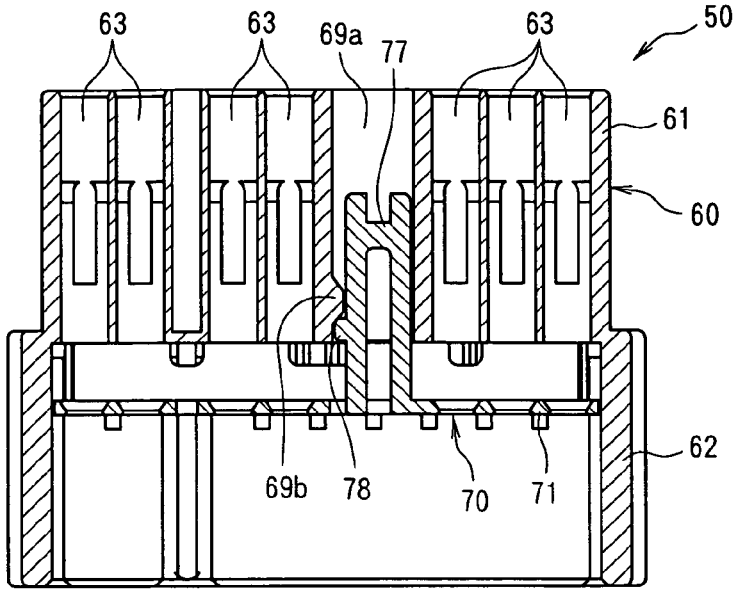
FIG. 9 is a sectional view along line 9—9 in FIG. 8B.
Figure 10:
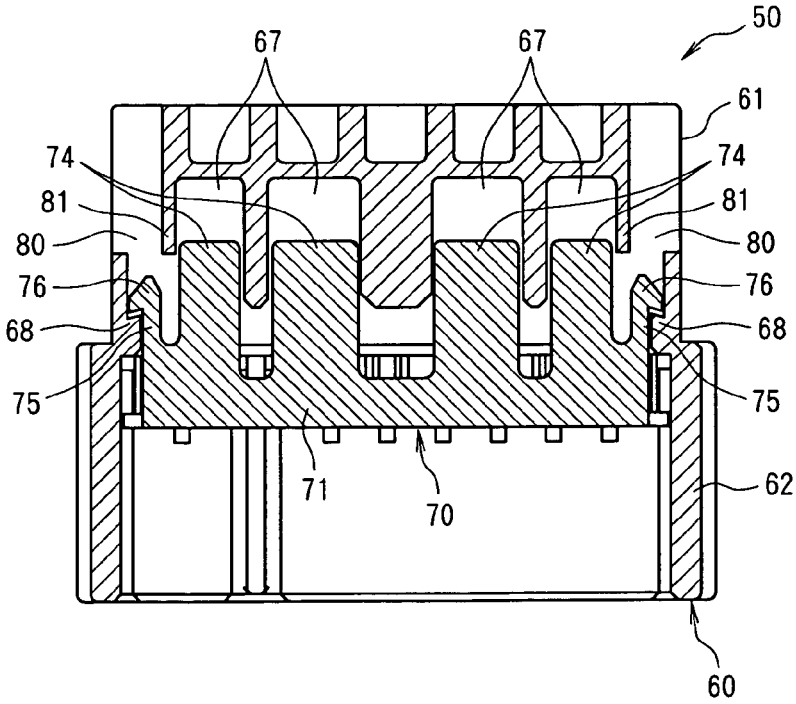
FIG. 10 is a sectional view along line 10—10 in FIG. 8B.

Furthermore, a plurality of long narrow openings 65 that extend in the forward-rearward direction are respectively formed in the top wall and bottom wall of the contact accommodating part 61 in positions corresponding to the respective contact accommodating cavities 63 in the left-right direction. Moreover, spaces 66 that permit flexing of the housing lances 64 and that allow the entry of the upper-side regulating parts 73*a* (described later) of the retainer 70 are formed above the housing lances 64 of the upper row so that these spaces 66 communicate with the long narrow openings 65. Furthermore, spaces 66 that permit flexing of the housing lances 64 and that allow the entry of the lower-side regulating parts 73*b* (described later) of the retainer 70 are also formed beneath the housing lances 64 of the lower row so that these spaces 66 communicate with the long narrow openings 65. The respective spaces 66 open on the front side of the contact accommodating part 61. In addition, as is shown in FIGS. 10 and 11, a plurality of spaces 67 that allow the entry of the center pieces 74 (described later) of the retainer 70 are formed between the contact accommodating cavities 63 of the upper row and the contact accommodating cavities 63 of the lower row. Furthermore, as is shown in FIG. 10, a pair of locking projections 68 to which the temporary locking projections 76 (described later) of the retainer 70 are locked are formed so that these projections 68 protrude to the inside of the left and right side walls of the contact accommodating part 61. Moreover, a through-hole 69*a* that passes through in the forward-rearward direction is formed substantially in the central part in the left-right direction of the contact accommodating part 61 between the adjacent contact accommodating cavities 63 as shown in FIG. 9. The through-hole 69*a* is designed for the entry of the main locking arm 77 (described later) of the retainer 70, and this through-hole 69*a* is formed with a locking projection 69*b* to which the main locking projection 78 (described later) of the retainer 70 is locked.

Furthermore, the hood part 62 has a substantially square shape in order to allow the mating with the plug connector 1 shown in FIG. 1A to 1C.

The retainer 70 is inserted from the front surface of the housing 60 via the hood part 62, and is locked in the housing 60 in a temporary locking position (see FIGS. 8A and 8B, 9 through 11) that allows the insertion of the contacts into the contact accommodating cavities 63 and in a main locking position (see FIGS. 12A and 12B, and 13 through 15) that double-locks the contacts. The retainer 70 comprises a substantially flat plate 71 that extends in the direction of length (left-right direction in FIG. 8B) so as to cover the front surface of the contact accommodating part 61, and a plurality of upper-side regulating parts 73*a* and lower-side regulating parts 73*b* that respectively extend rearward from the upper and lower ends of the plate 71.

Figure 18:
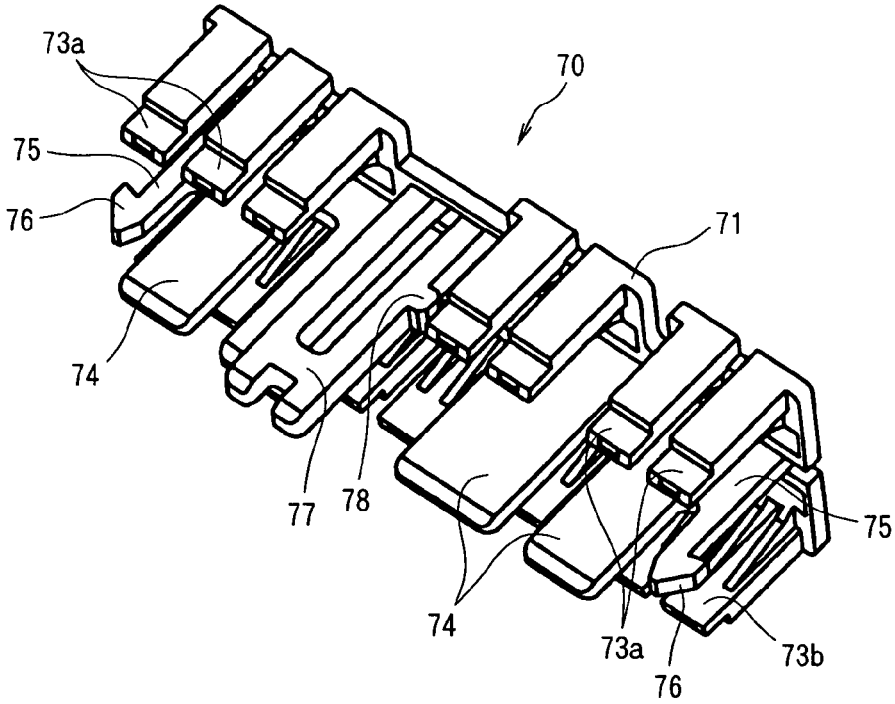
FIG. 18 is a perspective view of the retainer of FIG. 17 in which the retainer is seen from the rear at an inclination from above.
Figure 19A:
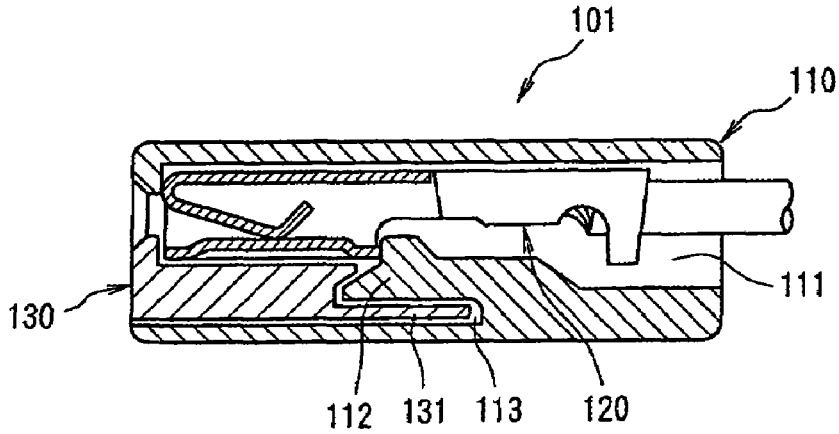
Prior Art FIG. 19A
FIGS. 19A and 19B show an electrical connector equipped with a conventional example of a front insertion type retainer, with FIG. 19A being a sectional view, and FIG. 19B being a perspective view.
Figure 19B:
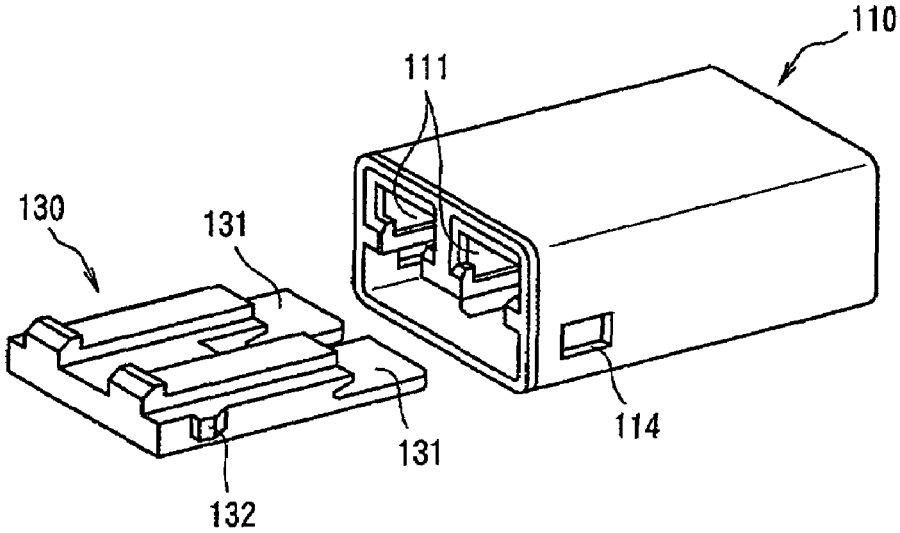
Prior Art FIG. 19B
Figure 20:
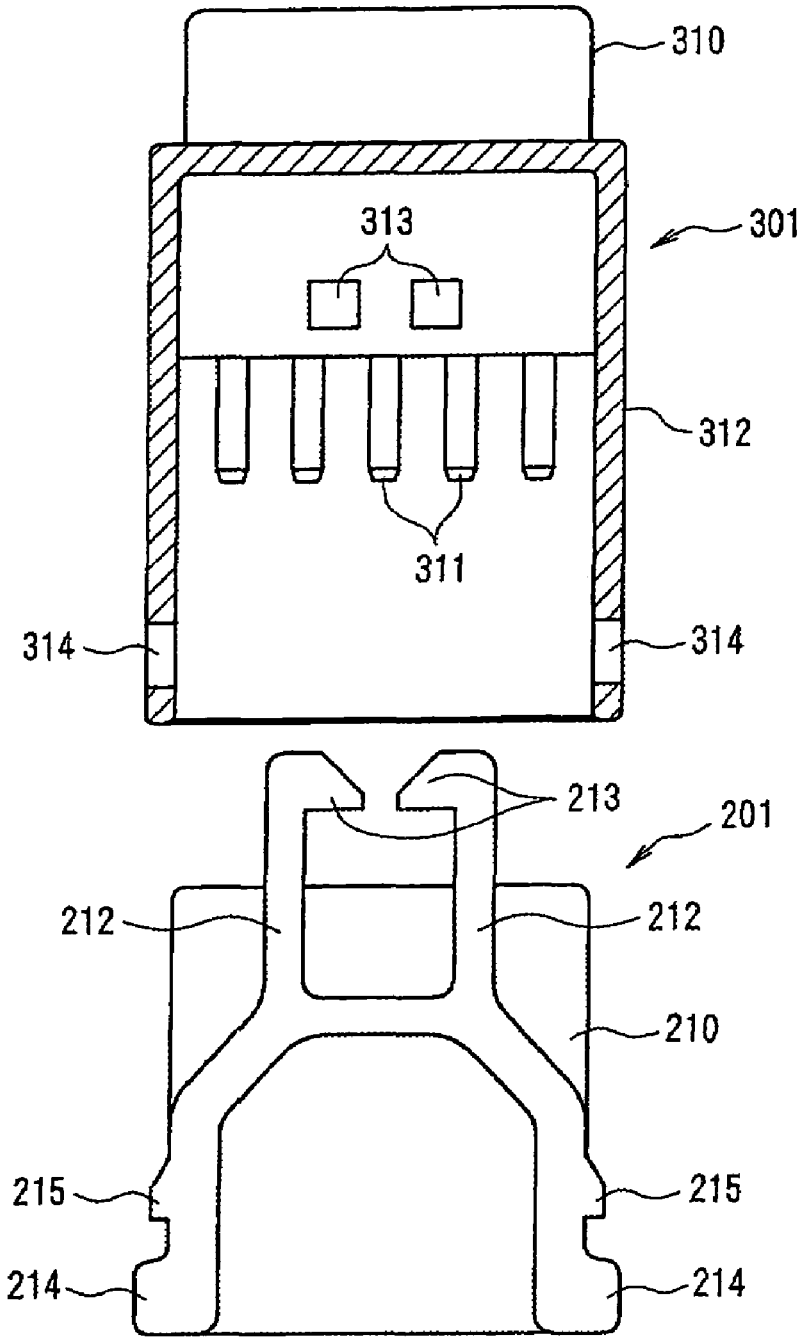
Prior Art FIG. 20
FIG. 20 is an explanatory diagram of another conventional example of an electrical connector.

The respective upper-side regulating parts 73*a* enter into the spaces 66 formed above the housing lances 64 at the time of main locking, and restrict the upward movement of the housing lances 64, thus ensuring that the contacts of the upper row do not slip out. Furthermore, the respective lower-side regulating parts 73*b* enter into the spaces 66 formed beneath the housing lances 64 at the time of main locking, and restrict the downward movement of the housing lances 64, thus ensuring that the contacts of the lower row do not slip out. A plurality of contact passage holes 72 are formed in the plate 71 to allow the male type contact parts of the contacts that are accommodated in the contact accommodating cavities 63 to pass through. Furthermore, as is shown clearly in FIGS. 10, 11 and 18, a plurality of center pieces 74 that enter into the plurality of spaces 67 formed in the contact accommodating part 61 are formed substantially in the central part (in the vertical direction) of the plate 71 of the retainer 70 so that these center pieces 74 extend rearward. Moreover, a pair of temporary locking arms 75 are formed at the left and right ends of the plate 71 so that these arms 75 extend rearward as shown in FIGS. 10 and 18. As is shown in FIG. 10, temporary locking projections 76 are formed on the rear ends of the respective temporary locking arms 75. The temporary locking projections 76 are positioned in the rear of the locking projections 68 formed on the contact accommodating part 61 and thus prevent the retainer 70 from being pulled out in the forward direction when the retainer 70 is in the temporary locking position. As is shown in FIG. 14, the temporary locking projections 76 are designed so that these projections 76 are exposed from the side surfaces of the housing 60 via openings 80 formed in the left and right side walls of the contact accommodating part 61 when the retainer 70 is in the main locking position.

Figure 13:
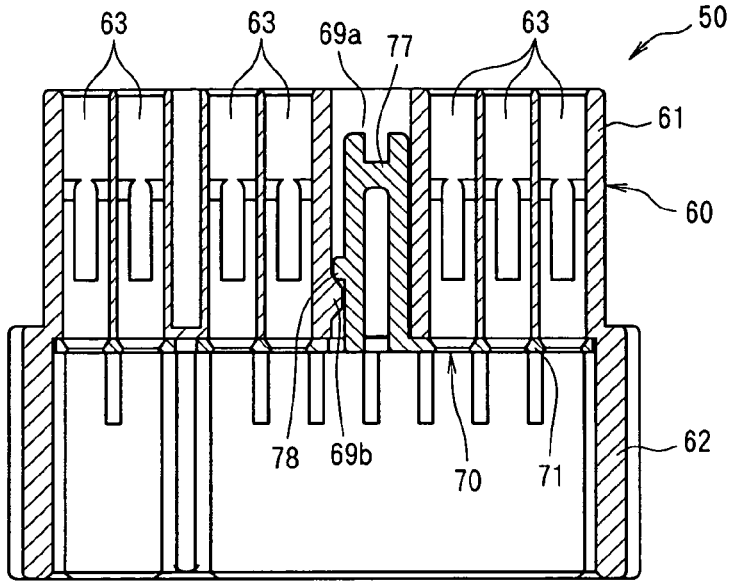
FIG. 13 is a sectional view along line 13—13 in FIG. 12B.

Furthermore, as is shown in FIGS. 9 and 18, a main locking arm 77 is formed so that this arm 77 extends to the rear substantially in the central part (in the left-right direction) of the plate 71 and between the upper-side regulating parts 73*a* and center pieces 74 in the vertical direction. The main locking arm 77 enters into the through-hole 69*a* formed in the contact accommodating part 61. Moreover, a main locking projection 78 is formed on the main locking arm 77 so that it protrudes from the left edge of the main locking arm 77. The main locking projection 78 prevents the retainer 70 from being pushed in toward the rear by being positioned to the front of the locking projection 69*b* formed in the contact accommodating part 61 when the retainer 70 is in the temporary locking position (as shown in FIG. 9). The main locking projection 78 also prevents the retainer 70 from being pulled out in the forward direction by being positioned to the rear of the locking projection 69*b* when the retainer 70 is in the main locking position (as shown in FIG. 13).

Figure 14:
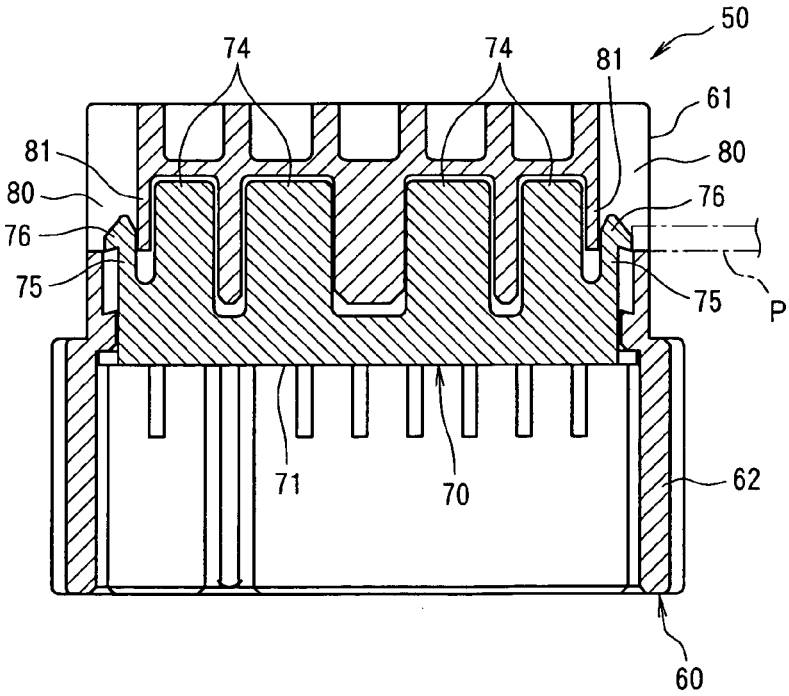
FIG. 14 is a sectional view along line 14—14 in FIG. 12B.

As is shown in FIG. 14, supporting parts 81 are formed on the left and right side walls of the contact accommodating part 61. These supporting parts 81 support the side of the back surfaces of the temporary locking arms 75 in the vicinity of the temporary locking projections 76 when the retainer 70 is in the main locking position.

Next, the method for assembling the cap connector 50 will be described with reference to FIGS. 8A and 8B, 9 through 11, 12A and 12B, and 13 through 15.

In the assembly of the cap connector 50, the retainer 70 is first inserted from the front surface of the housing 60, and the retainer 70 is positioned in the temporary locking position, as shown in FIG. 9 through 11. In this case, the retainer 70 is prevented from being pulled out in the forward direction as a result of the temporary locking projections 76 on the temporary locking arms 75 contacting the rear edges of the locking projections 68 formed on the contact accommodating part 61 as shown in FIG. 10, and the retainer 70 is prevented from being pushed in toward the rear as a result of the main locking projection 78 contacting the front edge of the locking projection 69*b* formed in the contact accommodating part 61 as shown in FIG. 9.

Next, the respective contacts 20 to which electrical wires (not shown in the figures) have been connected are inserted into the respective contact accommodating cavities 63 from the rear side of the housing 60. As a result, the housing lances 64 are positioned on the rear sides of the locking parts of the contacts, so that the contacts are tentatively secured, thus preventing the contacts from slipping out.

Figure 15:
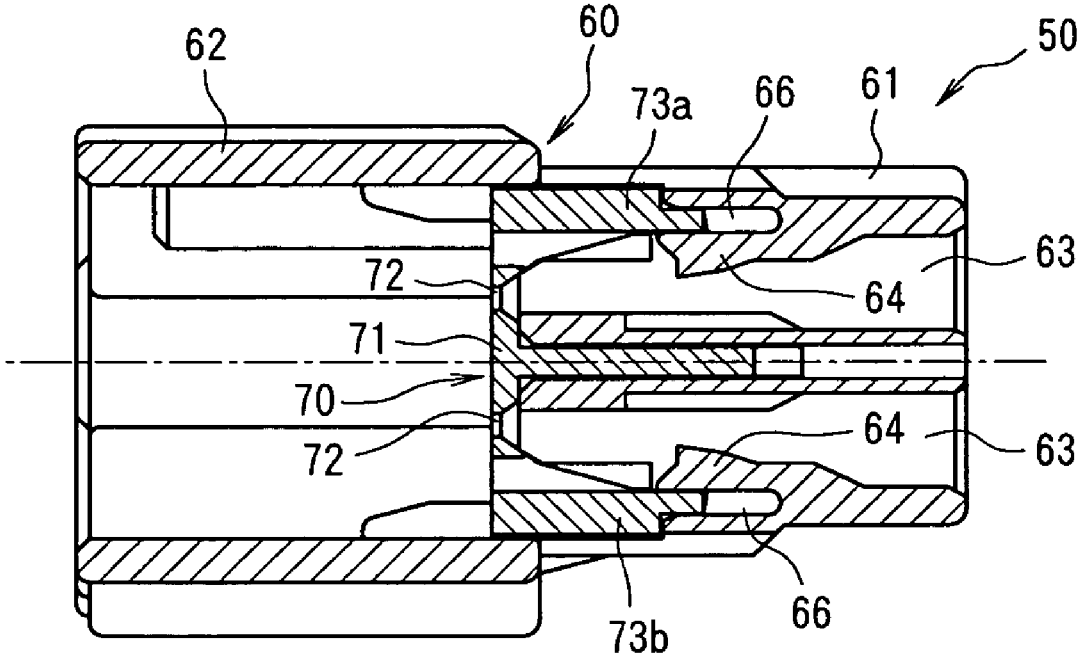
FIG. 15 is a sectional view along line 15—15 in FIG. 12B.
Figure 16:
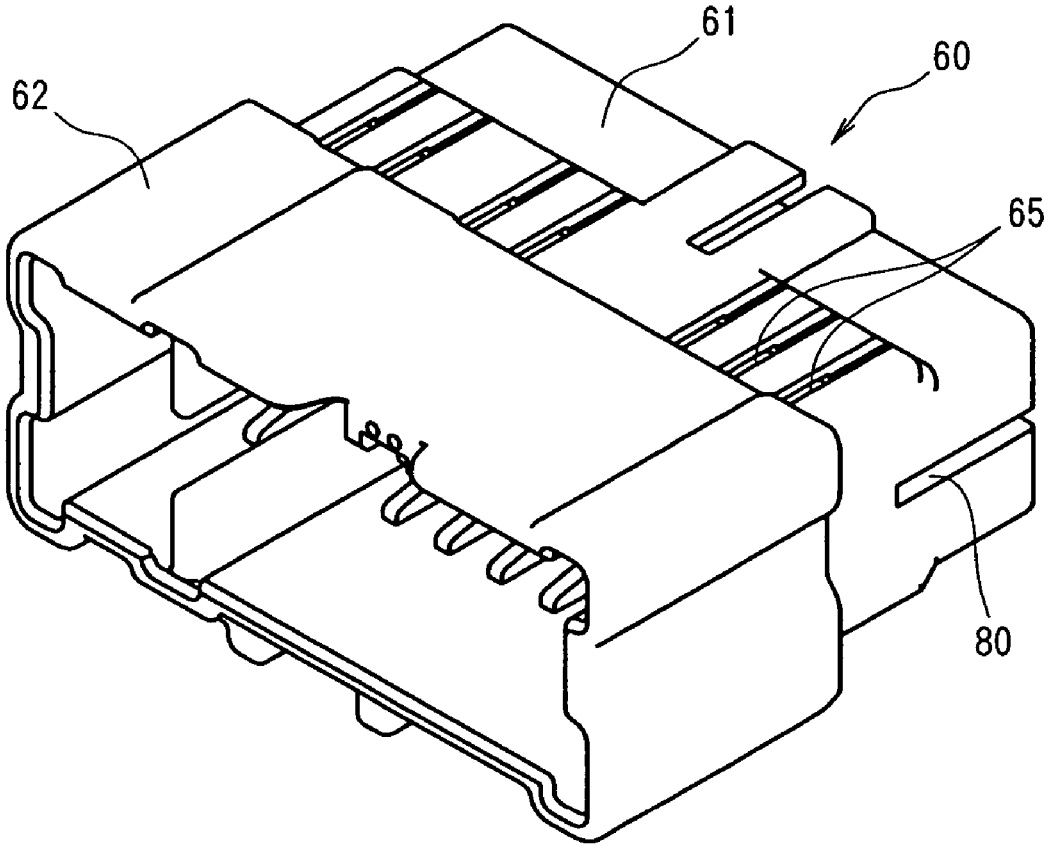
FIG. 16 is a perspective view of the housing of the cap connector of FIGS. 8A–11 in which the housing is seen from the front at an inclination from above.
Figure 17:
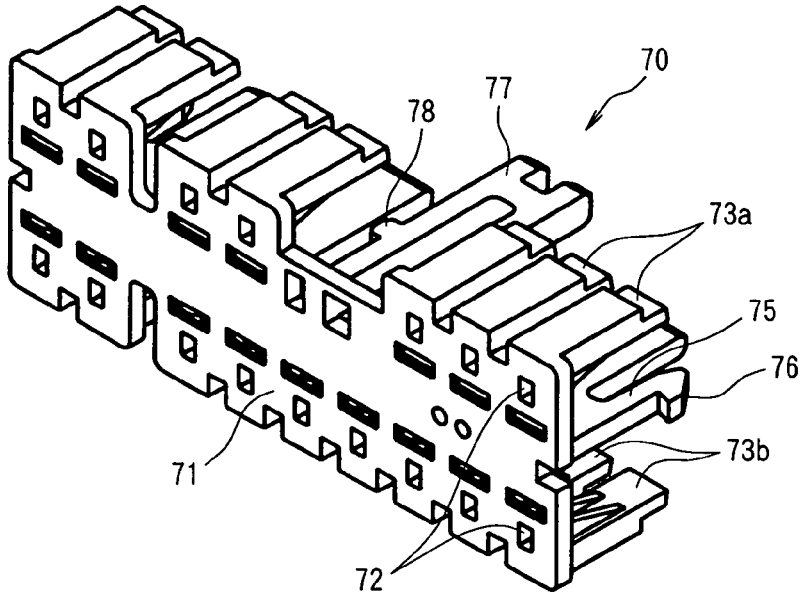
FIG. 17 is a perspective view of the retainer of the cap connector of FIGS. 8A–11 in which the retainer is seen from the front at an inclination from above.

Subsequently, the retainer 70 that is in the temporary locking position is pushed rearward so that the retainer 70 is positioned in the main locking position as shown in FIG. 13. In this case, the main locking arm 77 advances rearward inside the through-hole 69*a*, and the main locking projection 78 contacts the rear edge of the locking projection 69*b* formed in the contact accommodating part 61, so that the retainer 70 is prevented from being pulled out in the forward direction. In the case of this main locking, furthermore, the upper-side regulating parts 73*a* of the retainer 70 enter into the spaces 66 formed above the housing lances 64 (as shown in FIG. 15), so that the upward movement of the housing lances 64 is restricted, thus ensuring that the contacts of the upper row are prevented from slipping out. Moreover, the lower-side regulating parts 73*b* of the retainer 70 enter into the spaces 66 formed beneath the housing lances 64, so that the downward movement of the housing lances 64 is restricted, thus ensuring that the contacts of the lower row are prevented from slipping out. As a result, the assembly of the cap connector 50 is completed.

When the retainer 70 is in the main locking position, the temporary locking projections 76 formed on the temporary locking arms 75 are exposed from the side surfaces of the housing 60 via the openings 80 as shown in FIG. 14, so that the temporary locking projections 76 can be visually confirmed from the side surfaces of the housing 60. As a result, the state of the retainer 70 in the main locking position can easily be confirmed by visual inspection.

Moreover, since the temporary locking projections 76 are exposed from the side surfaces of the housing 60 via the openings 80 when the retainer 70 is in the main locking position, the state of the retainer 70 in the main locking position can also be detected by causing an inspection probe P to contact the side surfaces of the temporary locking projections 76 from the side of the side surfaces of the housing 60 as shown in FIG. 14, and by measuring the height of the temporary locking projections 76 from a specified reference. In this case, since the supporting parts 81, which support the back surface of the temporary locking arms 75 in the vicinity of the temporary locking projections 76 when the retainer 70 is in the main locking position, are formed on the side walls of the contact accommodating part 61, even if the inspection probe P is caused to contact the side surfaces of the temporary locking projections 76 from the side of the side surfaces of the housing 60, there is no retraction of the temporary locking projections 76. Consequently, the state of the retainer 70 in the main locking position can be securely detected. Furthermore, the outer surfaces of the temporary locking projections 76 are formed as flat surfaces that allow surface contact with the inspection probe P.

What is claimed is:

1. An electrical connector comprising:

an insulating housing;

contacts accommodated in the insulating housing;

a retainer that is inserted from a front surface of the insulating housing, the retainer being locked to the insulating housing in a temporary locking position that allows the insertion of the contacts into the insulating housing and in a main locking position that ensures that the contacts are prevented from slipping out of the insulating housing;

the retainer having main locking arms extending to a free end thereof and comprising main locking projections that prevent the retainer from being pushed inward when the retainer is in the temporary locking position and that prevent the retainer from being pulled out when the retainer is in the main locking position, the main locking projections being exposed from side surfaces of the insulating housing when the retainer is in the main locking position;and the insulating housing having supporting parts that support a back surface of the main locking arms at the free end and in a vicinity of the main locking projections when the retainer is in the main locking position.

2. The electrical connector according to claim 1, wherein flex permitting spaces that allow flexing of the main locking arms of the retainer are formed in positions located further forward than the supporting parts of the insulating housing.

3. The electrical connector according to claim 1, wherein the retainer comprises side regulating parts with temporary locking projections that engage the insulating housing in the temporary locking position.

4. An electrical connector comprising:

an insulating housing;

contacts accommodated in the insulating housing;

a retainer that is inserted from a front surface of the insulating housing, the retainer being locked to the insulating housing in a temporary locking position that allows the insertion of the contacts into the housing and in a main locking position that ensures that the contacts are prevented from slipping out of the insulating housing, the retainer having temporary locking arms extending to a free end thereof and comprising temporary locking projections that prevent the retainer from being pulled out when the retainer is in the temporary locking position, the temporary locking projections being exposed from side surfaces of the insulating housing when the retainer is in the main locking position; and the insulating housing having supporting parts that support a back surface of the temporary locking arms at the free end and in a vicinity of the temporary locking projections when the retainer is in the main locking position.

5. An electrical connector comprising:

an insulating housing;

contacts accommodated in the insulating housing;

housing lances disposed within the insulating housing with spaces adjacent to the housing lances that allow the housing lances to flex to accommodate insertion of the contacts into the insulating housing, the housing lances securing the contacts in the insulating housing; and a retainer that is inserted from a front surface of the insulating housing and that is locked to the housing in a temporary locking position that allows the insertion of the contacts into the insulating housing and in a main locking position that ensures that the contacts are prevented from slipping out of the insulating housing, the retainer having main locking arms and temporary locking arms, the main locking arms comprising main locking projections that prevent the retainer from being pushed inward when the retainer is in the temporary locking position and that prevent the retainer from being pulled out when the retainer is in the main locking position, the main locking projections being exposed through openings in the insulating housing when the retainer is in the main locking position, the temporary locking arms comprising temporary locking projections that prevent the retainer from being pulled out when the retainer is in the temporary locking position; and the housing having supporting parts that support a back surface of the main locking arms in a vicinity of the main locking projections when the retainer is in the main locking position.

6. The electrical connector of claim 5, wherein the temporary locking arms are disposed in a space adjacent to the housing lances when the retainer is in themain locking position.

* * * * *